US011447884B2

(12) United States Patent
Rüther et al.

(10) Patent No.: US 11,447,884 B2
(45) Date of Patent: Sep. 20, 2022

(54) METHOD FOR ELECTROLYTICALLY PASSIVATING A SURFACE OF SILVER, SILVER ALLOY, GOLD, OR GOLD ALLOY

(71) Applicant: Atotech Deutschland GmbH, Berlin (DE)

(72) Inventors: Robert Rüther, Berlin (DE); Olaf Kurtz, Berlin (DE); Joko Setyadi-Lie, Berlin (DE); Tse-Cheen Foong, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 0 days.

(21) Appl. No.: 17/284,902

(22) PCT Filed: Oct. 18, 2019

(86) PCT No.: PCT/EP2019/078345
§ 371 (c)(1),
(2) Date: Apr. 13, 2021

(87) PCT Pub. No.: WO2020/079215
PCT Pub. Date: Apr. 23, 2020

(65) Prior Publication Data

US 2021/0348291 A1 Nov. 11, 2021

(30) Foreign Application Priority Data

Oct. 19, 2018 (EP) ..... 18201553

(51) Int. Cl.

| | |
|---|---|
| ***C25D 3/06*** | (2006.01) |
| ***C25D 3/10*** | (2006.01) |
| ***C25D 5/00*** | (2006.01) |
| ***C25D 11/00*** | (2006.01) |
| ***C25D 11/38*** | (2006.01) |

(52) U.S. Cl.
CPC ..... *C25D 3/06* (2013.01)

(58) Field of Classification Search
CPC ... C25D 3/06; C25D 3/10; C25D 5/00; C25D 11/00; C25D 11/38
USPC ..... 205/287, 289, 290, 319
See application file for complete search history.

(56) References Cited

U.S. PATENT DOCUMENTS

| | | | | |
|---|---|---|---|---|
| 947,347 | A | 1/1910 | Phillips | |
| 4,169,022 | A | 9/1979 | Ward et al. | |
| 2004/0040859 | A1* | 3/2004 | Lansdell | C25D 5/48 428/673 |
| 2004/0139876 | A1* | 7/2004 | Wilson | F42B 3/12 102/202.11 |
| 2009/0008259 | A1* | 1/2009 | Chan | C23C 28/025 205/192 |
| 2014/0154525 | A1* | 6/2014 | Van Schaik | C25D 5/48 560/147 |
| 2015/0329981 | A1 | 11/2015 | Wijenberg et al. | |
| 2016/0208390 | A1 | 7/2016 | Shinozaki et al. | |
| 2016/0208391 | A1 | 7/2016 | Shinozaki et al. | |
| 2017/0009361 | A1* | 1/2017 | Dal Ziliio | C25D 17/002 |
| 2017/0009363 | A1 | 1/2017 | Hiramatsu | |

FOREIGN PATENT DOCUMENTS

| | | | | |
|---|---|---|---|---|
| DE | 2657012 | A1 | 6/1977 | |
| GB | 1193352 | A | 5/1970 | |
| JP | 2008184657 | A | 8/2008 | |
| SU | 1682412 | A1 * | 10/1991 | C25D 11/38 |
| TW | 201042082 | A | 12/2010 | |
| WO | 2006132426 | A2 | 12/2006 | |
| WO | 2014079911 | A2 | 5/2014 | |

OTHER PUBLICATIONS

Hagans et al., "Chromate Conversion Coatings," ASM Handbook (1994), vol. 5, pp. 405-411. (Year: 1994).*
PCT/EP2019/078345; PCT International Search Report and Written Opinion of the International Searching Authority dated Jan. 13, 2020.

* cited by examiner

*Primary Examiner* — Edna Wong
(74) *Attorney, Agent, or Firm* — Renner, Otto, Boisselle & Sklar, LLP

(57) ABSTRACT

A method for electrolytically passivating a surface of silver, silver alloy, gold, or gold alloy, the method comprising the steps of (i) providing a substrate comprising the surface, (ii) providing an aqueous passivation solution comprising trivalent chromium ions, and
one or more than one species of carboxylic acid residue anions, (iii) contacting the substrate with the passivation solution and passing an electrical current between the substrate as a cathode and an anode such that a passivation layer is electrolytically deposited onto the surface, wherein the trivalent chromium ions with respect to all species of carboxylic acid residue anions form a molar ratio in the range from 1:10 to 1:400.

15 Claims, No Drawings

METHOD FOR ELECTROLYTICALLY PASSIVATING A SURFACE OF SILVER, SILVER ALLOY, GOLD, OR GOLD ALLOY

The present application is a U.S. National Stage Application based on and claiming benefit and priority under 35 U.S.C. § 371 of International Application No. PCT/EP2019/078345, filed 18 Oct. 2019, which in turn claims benefit of and priority to European Application No. 18201553.7 filed 19 Oct. 2018, the entirety of both of which is hereby incorporated herein by reference.

FIELD OF THE INVENTION

The present invention relates to a method for electrolytically passivating a surface of silver, silver alloy, gold, or gold alloy, and a respective passivation solution.

BACKGROUND OF THE INVENTION

In decorative as well as in functional applications silver is often utilized due to its bright, shiny appearance, and excellent conductivity and temperature properties, respectively. On the one hand, silver is used in manufacturing jewelry and advantageously it usually does not cause skin irritations. On the other hand, silver is also utilized in manufacturing printed circuit boards and functional connectors for electronic parts. However, irrespective of the intended purpose, substrates comprising a respective surface of silver suffer the disadvantage that in the presence of ambient air an undesired tarnishing occurs over time. This tarnish typically comprises silver sulfide and exhibits an undesired discoloration including for example brownish, reddish, yellowish, and black colors. Such tarnish negatively affects the appearance of decorative articles and the functional properties of respective electronic parts.

In functional applications also gold, in particular gold alloys, are frequently utilized. Although gold inherently is not susceptible to tarnishing caused by ambient air, undesired discoloration and even oxidation may occur due to pores in the deposited gold, in particular if very thin gold layers are utilized. Such pores might foster the formation of oxides with metals underneath the deposited gold.

In the art various silver/gold surface treatments are known in order to prevent or at least minimize said tarnishing/discoloration.

U.S. Pat. No. 4,169,022 A relates to the deposition of corrosion resistant coatings on metal substrates and particularly to a method of depositing protective coatings containing $Cr_2O_3$. Typical substrates include silver and gold.

GB 1,193,352 A relates to a method of rendering the surface of silver passive by cataphoresis using an aqueous solution, containing crystalline beryllium sulphate.

US 2015/0329981 A1 relates to chromium-chromium oxide coatings applied to steel substrates for packaging applications and to a method for producing said coatings.

Although surface treatments and respective passivation solutions are known, which indeed show very good passivation results, in many cases they are not sufficient and/or not satisfying. For example, in some cases the pH of respective solutions is too acidic. This is undesired in particular in functional applications because in many cases silver is electrolytically deposited from a cyanide-containing silver bath. Although a rinsing step is carried out between silver deposition and silver passivation, a cyanide contamination of the passivation solution can occur. This is problematic due to the potential formation of toxic HCN.

Furthermore, in many cases respective passivation solutions exhibit an inacceptable life time. Very often undesired precipitation occurs after a comparatively short utilization, in particular in passivation solutions being weakly acidic or having even a neutral pH.

In addition, in many cases it has been observed that upon utilization of respective passivation solutions an inacceptable concentration of hexavalent chromium is formed over time if the passivation is achieved by means of trivalent chromium ions. This is not acceptable and must be avoided.

Also, it has been observed that in many cases the passivation is not sufficient. This means that e.g. under increased temperatures, although a passivation is present, the passivation fails over time and the undesired tarnish appears anyway.

OBJECTIVE OF THE PRESENT INVENTION

It was therefore the objective of the present invention, based on the above mentioned prior art, to provide an improved method for passivation, including an improved passivation solution. This in particular means that besides a passivation layer with an excellent passivation result (including an excellent passivation also under increased temperatures), additionally a passivation solution with increased life time, i.e. high stability without significant precipitation, is desired at weakly acidic or even neutral pH values. This simplifies waste water treatment and avoids undesired HCN formation, which additionally increases the life time of a respective passivation solution. Furthermore, it was an objective to provide a robust method, which means that a broad operating window is available in terms of pH, temperature and current density. Most important, it was an objective to minimize the anodic formation of hexavalent chromium in a respective passivation solution. The presence of hexavalent chromium often causes degradation of organic compounds, which furthermore reduces the life time of such a solution.

Another objective is to provide a respective passivation solution that can be utilized in such a method and the respective use of such a passivation solution.

DESCRIPTION OF THE INVENTION

The above mentioned objective is solved by a method for electrolytically passivating a surface of silver, silver alloy, gold, or gold alloy, the method comprising the steps of (i) providing a substrate comprising said surface, (ii) providing an aqueous passivation solution comprising trivalent chromium ions, and
one or more than one species of carboxylic acid residue anions, (iii) contacting the substrate with said passivation solution and passing an electrical current between the substrate as a cathode and an anode such that a passivation layer is electrolytically deposited onto said surface, wherein the trivalent chromium ions with respect to all species of carboxylic acid residue anions form a molar ratio in the range from 1:10 to 1:400.

Own experiments have shown that the method of the present invention does not only provide a passivation layer with an excellent passivation result, in particular a layer with excellent corrosion resistance despite the presence of increased temperatures, but additionally provides a significantly increased life time and stability for the passivation solution utilized in steps (ii) and (iii) of the method of the present invention. No significant or disturbing precipitation was observed at weakly acidic pH values in the solution. Furthermore, the method of the present invention is very robust because minor variations in pH, temperature and current density do not affect the excellent passivation result and therefore, show a desirably broad operating window. Furthermore, during the method of the present invention, only insignificant concentrations of hexavalent chromium are formed in the aqueous passivation solution, typically significantly below 2 ppm.

The method of the present invention is an excellent alternative passivation treatment compared to conventional passivation methods based on hexavalent chromium or a passivation with organic passivation layers. A passivation based on hexavalent chromium is environmentally questionable and threatens people's health. Although an organic passivation is environmentally more acceptable, heat resistance is a critical issue due to the susceptibility to thermal degradation of the organic layer.

The method of the present invention comprises at least two preparation steps, steps (i) and (ii); step (iii) is the actual passivation step. After step (iii) a passivated surface of silver, silver alloy, gold, or gold alloy is obtained by having an electrolytically deposited passivation layer on said surface.

In the method of the present invention, a surface of silver, silver alloy, gold, or gold alloy is electrolytically passivated. Even more preferred is a method of the present invention, wherein a surface of silver or silver alloy is electrolytically passivated, most preferred a surface of silver. However, in other cases a method of the present invention is preferred, wherein a surface of gold or gold alloy is electrolytically passivated, more preferably a surface of gold.

In some cases a method of the present invention is preferred, wherein the surface of silver, silver alloy, gold, or gold alloy is formed by wet-chemical deposition, more preferably by electrolytic deposition, by immersion deposition, or by electroless deposition, most preferably by electrolytic deposition. In other cases a method of the present invention is preferred, wherein the surface of silver, silver alloy, gold, or gold alloy is formed by physical formation, preferably casting or sputtering. In the context of the present invention, there is no particular relevance as to how the surface of silver, silver alloy, gold, or gold alloy is formed. The method of the present invention can be applied in all these cases.

Preferred is a method of the present invention, wherein in step (i) the surface of silver alloy comprises one or more than one alloying element selected from the group consisting of gold, copper, antimony, bismuth, nickel, tin, palladium, platinum, rhodium, ruthenium, gallium, germanium, indium, zinc, phosphorous, selenium, sulfur, carbon, nitrogen, and oxygen, preferably one or more than one alloying element selected from the group consisting of copper, antimony, gold, carbon, nitrogen, and oxygen. Preferably, the amount of each of carbon and nitrogen is 0.5 atom-% or less, based on the total amount of atoms in the surface. Preferably, above mentioned alloying elements are the only allying elements in the surface of silver alloy.

Preferred is a method of the present invention, wherein in step (i) the surface of gold alloy comprises one or more than one alloying element selected from the group consisting of silver, cobalt, nickel, iron, copper, palladium, platinum, rhodium, tin, bismuth, indium, zinc, silicon, carbon, nitrogen, and oxygen, preferably one or more than one alloying element selected from the group consisting of silver, copper, nickel, cobalt, iron, carbon, nitrogen, and oxygen. In particular preferred in step (i) is a surface of gold alloy comprising gold, silver, and copper or comprising gold, nickel, cobalt, and iron. Preferably, above mentioned alloying elements are the only allying elements in the surface of gold alloy.

Preferred is a method of the present invention, wherein in step (i) the surface of silver alloy and gold alloy, respectively, individually comprises a total amount of silver and gold, respectively, of 55 atom-% or more, based on the total amount of atoms in the respective surface, preferably 65 atom-% or more, more preferably 75 atom-% or more, even more preferably 85 atom-% or more, most preferably 95 atom-% or more, even most preferably 98 atom-% or more. This means that in the surface of silver alloy the majority of all atoms are silver atoms (at least 55 atom-%), respectively, in the surface of gold alloy the majority of all atoms are gold atoms (at least 55 atom-%).

Preferred is a method of the present invention, wherein in step (i) the surface of gold or silver is a surface of pure gold and pure silver, respectively. In the context of the present invention, pure denotes 99.9 atom-% or more, based on the total amount of atoms in the respective surface, preferably 99.95 atom-% or more, most preferably 99.99 atom-% or more.

Preferably, the surface of silver, silver alloy, gold, or gold alloy is the surface of a layer of silver, silver alloy, gold, or gold alloy, respectively, the layer being (a) directly arranged on a metal base-substrate or (b) on one or more than one metal/metal alloy layer of a layer stack, the layer stack being arranged on a metal base-substrate or an organic base-substrate. In each case, a substrate comprising said surface results and is provided as defined in step (i) of the method of the present invention. In the context of the present invention, "providing" includes "manufacturing" same.

Preferred is a method of the present invention, wherein the respective layer of silver, silver alloy, gold, or gold alloy has a layer thickness of at least 5 nm. Preferably, the layer of silver and silver alloy, respectively, has a layer thickness in the range from 5 nm to 500 nm, preferably from 10 nm to 400 nm, more preferably from 40 nm to 300 nm. Preferably, the layer of gold and gold alloy, respectively, has a layer thickness in the range from 5 nm to 10000 nm, preferably from 10 nm to 5000 nm. Most preferably, aforementioned layer thicknesses are a result of a wet-chemical deposition of the respective metal and metal alloy.

Preferably, the layer of silver, silver alloy, gold, or gold alloy, respectively, is (a) directly arranged on said metal base-substrate or (b) on said layer stack, by a wet-chemical deposition, preferably by electrolytic deposition.

Preferably, the layer stack comprises one or more than one layer selected from the group consisting of a nickel layer, a nickel alloy layer, a copper layer, a copper alloy layer, and a noble metal seed layer.

Preferably, the metal base-substrate comprises one or more than one metal selected from the group consisting of iron, magnesium, nickel, zinc, tin, aluminum, and copper, preferably iron, copper, tin, and zinc. More preferably, the metal base substrate is an electronic part, most preferably an electronic part made of copper and/or copper alloy. Preferred copper alloys comprise brass and bronze.

Preferably, in step (i) the substrate comprising said surface is a substrate with a cleansed surface. Therefore, preferred is a method of the present invention, wherein step (i) includes step (ia) cleaning the surface with a cleaning solution, preferably an alkaline cleaning solution, each optionally including ultrasonic.

Preferably, the cleaning solution, preferably the alkaline cleaning solution, comprises at least one wetting agent.

In some cases a method of the present invention is preferred comprising step (ib) cleaning the surface obtained after step (ia) by cathodic degreasing.

In step (ii) of the method of the present invention, the aqueous passivation solution is provided. The following parameters and characteristics of the aqueous passivation solution typically refer to the final state of the solution, ready for utilization in step (iii) of the method of the present invention.

Preferred is a method of the present invention, wherein the aqueous passivation solution has a pH in the range from 3.1 to 7.5, preferably from 4.1 to 7.2, more preferably from 4.9 to 6.9, even more preferably from 5.4 to 6.7, most preferably from 5.8 to 6.6. Generally preferred is a pH in the range from 5.8 to 6.9, preferably from 6.0 to 6.6, because in these pH ranges an excellent stability without precipitation is obtained. In the context of the present invention, pH is referenced to a temperature of 20° C. If the pH is significantly above 7.5, an undesired precipitation is observed in the aqueous passivation solution, which unacceptably affects the solution's stability and life time. An undisturbing and minor precipitation starts to occur at a pH above 6.9. Although such an undisturbing precipitation is acceptable from the technically point of view, from the commercial perspective such an aqueous passivation solution is less desired. If the pH is significantly below 3.1, a strong and inacceptable precipitation is observed in the passivation solution.

A minor precipitation sometimes starts to occur between pH 3.1 and approximately 4.5, which again is less acceptable from a commercial perspective. Good results are obtained at a pH in the range from 4.9 to 6.9, which is also a preferred pH range. Very good results are obtained at a pH in the range from 5.4 to 6.9, which is even more preferred. Preferably, in the method of the present invention the pH of the aqueous passivation solution is increased by means of potassium hydroxide and decreased by means of formic acid.

Preferred is a method of the present invention, wherein the concentration of trivalent chromium ions in the aqueous passivation solution is in the range from 0.1 g/L to 5.0 g/L, based on the total volume of the passivation solution, preferably in the range from 0.2 g/L to 4.0 g/L, more preferably in the range from 0.3 g/L to 3.0 g/L, even more preferably in the range from 0.4 g/L to 2.0 g/L, most preferably in the range from 0.5 g/L to 1.5 g/L, even most preferably in the range from 0.6 g/L to 1.2 g/L. Said concentration is referenced to a molecular weight of 52 g/mol for chromium, i.e. to its non-complexed form. If the concentration of trivalent chromium ions is significantly below 0.1 g/L, no passivation effect is usually observed. If the total amount significantly exceeds 5 g/L metallic chromium is sporadically deposited or a too thick passivation layer is deposited, each unacceptably changing the optical appearance of the surface of silver, silver alloy, gold, and gold alloy, respectively, and causing an inhomogeneous optical appearance. Furthermore, the concentration of anodically formed undesired hexavalent chromium also increases. If the concentration is above 4.0 g/L in some cases a tarnish/haze is observed although the passivation effect is still acceptable. However, the tendency of forming such a tarnish/haze is significantly reduced if the concentration is 4.0 g/L or less, and is even further reduced if the concentration is 3.0 g/L or less. Very good results are obtained if the concentration is 2 g/L or less, and excellent results are obtained if the concentration is in the range from 0.5 g/L to 1.5 g/L, which results in a passivation layer not deteriorating the appearance of the surface of silver, silver alloy, gold, and gold alloy, respectively. As mentioned above, the concentration of trivalent chromium ions is referenced to their non-complexed form. However, this does not exclude that said trivalent chromium ions are present in a complexed form in the aqueous passivation solution.

The aqueous passivation solution utilized in the method of the present invention comprises one or more than one species of carboxylic acid residue anions. Said carboxylic acid residue anions primarily serve as complexing agents for said trivalent chromium ions.

In the aqueous passivation solution the one or more than one species of carboxylic acid residue anions is protonated (i.e. is present as the respective carboxylic acid) or deprotonated (i.e. is present as the respective carboxylic acid residue anion), depending on the solution's pH, the acid's dissociation constant, and the complexes including said carboxylic acid residue anions. If a species of carboxylic acid residue anions contains more than one carboxylic group, the species may be partly protonated and deprotonated, respectively.

Preferred is a method of the present invention, wherein the one or more than one species of carboxylic acid residue anions does not comprise a hydroxyl group, i.e. is not a species of hydroxyl carboxylic acid residue anions. Most preferably, said one or more than one species of carboxylic acid residue anions only comprise carboxyl groups as functional groups.

Preferred is a method of the present invention, wherein the one or more than one species of carboxylic acid residue anions are species of aliphatic carboxylic acid residue anions, preferably of aliphatic mono- or di-carboxylic acid residue anions, even more preferably of aliphatic mono- or di-carboxylic acid residue anions comprising 1 to 4 carbon atoms.

In many cases a method of the present invention is preferred, wherein the one or more than one species of carboxylic acid residue anions are species of aliphatic mono-carboxylic acid residue anions, even more preferably of aliphatic mono-carboxylic acid residue anions comprising 1 to 4 carbon atoms. This means that in such cases the aqueous passivation solution preferably does not comprise species of di-carboxylic acid residue anions comprising 1 to 4 carbon atoms, preferably does not comprise species of di-carboxylic acid residue anions at all.

However, in some other but less preferred cases a method of the present invention is preferred, wherein the one or more than one species of carboxylic acid residue anions are species of aliphatic di-carboxylic acid residue anions, even more preferably of aliphatic di-carboxylic acid residue anions comprising 1 to 4 carbon atoms. This means that in such cases the aqueous passivation solution preferably does not comprise species of mono-carboxylic acid residue anions comprising 1 to 4 carbon atoms, preferably does not comprise species of mono-carboxylic acid residue anions at all.

Very preferred is a method of the present invention, wherein the one or more than one species of carboxylic acid residue anions comprises formate anions and/or oxalate anions, preferably formate anions and/or oxalate anions are the only species of carboxylic acid residue anions in the aqueous passivation solution.

In many cases even more preferred is a method of the present invention, wherein the one or more than one species of carboxylic acid residue anions comprises formate anions, preferably formate anions is the only species of carboxylic acid residue anions in the aqueous passivation solution. In this very preferred case, the aqueous passivation solution preferably does not comprise oxalate anions, most preferably does not comprise any other complexing agent for trivalent chromium ions.

However, in some other but less preferred cases a method of the present invention is preferred, wherein the one or more than one species of carboxylic acid residue anions comprises oxalate anions, preferably oxalate anions is the only species of carboxylic acid residue anions in the aqueous passivation solution. In this very preferred case, the aqueous passivation solution preferably does not comprise formate anions, most preferably does not comprise any other complexing agent for trivalent chromium ions.

Thus, a method of the present invention is preferred, wherein the aqueous passivation solution comprises only one species of carboxylic acid residue anions, preferably only one species of carboxylic acid residue anions as described in the text above as being preferred.

The advantage of the present invention is primarily based on the finding that the trivalent chromium ions with respect to all species of carboxylic acid residue anions form a molar ratio in the range from 1:10 to 1:400. This in particular and most preferably applies to the above defined preferred species of carboxylic acid residue anions, preferably if they are the only species of carboxylic acid residue anions in the aqueous passivation solution. In each case this means that the molar amount of said one or more than one species of carboxylic acid residue anions is significantly higher than the molar amount of said trivalent chromium ions.

Preferred is a method of the present invention, wherein in the passivation solution the molar ratio is in the range from 1:15 to 1:350, preferably in the range from 1:25 to 1:300, more preferably in the range from 1:40 to 1:250, even more preferably in the range from 1:55 to 1:200, most preferably in the range from 1:75 to 1:170, even most preferably in the range from 1:95 to 1:150, in particular preferably in the range from 1:110 to 1:130. This includes that the molar ratio is most preferably at least 1:100 (i.e. 0.01) or less. Other preferred minimum values in above mentioned molar ratios are 1:375, 1:325, 1:275, 1:225, 1:190, 1:175, 1:165, 1:155, 1:145, 1:135, which can be freely combined with each aforementioned maximum value of said molar ratio, e.g. 1:15, 1:25, etc. in order to arrive at further combinations, which are herewith disclosed in the context of the present invention. This likewise applies to the passivation solution of the present invention (see text below).

Said molar ratio largely affects the stability and life time, respectively, of the passivation solution and the anodic formation of undesired hexavalent chromium during step (iii) of the method of the present invention. In the context of the present invention, the term hexavalent chromium refers to compounds and ions comprising chromium with the oxidation state +6. Lowest concentrations of hexavalent chromium, typically 2 ppm or less, and an excellent stability were obtained with a molar ratio in the range from 1:95 to 1:150 and 1:110 to 1:130, respectively, most preferably together with a very preferred pH range as described throughout the text. An undisturbing but noticeable precipitation as well as a slightly increased but still acceptable concentration of hexavalent chromium, typically in the range from 2 ppm to 5 ppm, is observed outside the range from 1:95 to 1:150 but inside the broadest ranges mentioned above. If the molar ratio is significantly higher than 0.1 (>1:10) unacceptable precipitation and too high concentrations of hexavalent chromium (significantly above 8 ppm) are obtained. Such an unacceptably high concentration of hexavalent chromium is also obtained if the molar ratio is significantly below 0.0025 (<1:400).

Preferred is a method of the present invention, wherein the aqueous passivation solution comprises hexavalent chromium in a total concentration in the range from 0 ppm to 6.0 ppm, based on the total weight of the aqueous passivation solution and referenced to a molecular weight of 52 g/mol for atomic chromium, preferably in the range from 0 ppm to 5.0 ppm, more preferably in the range from 0 ppm to 4.0 ppm, even more preferably in the range from 0 ppm to 3.0 ppm, most preferably in the range from 0 ppm to 2.5.0 ppm, even most preferably in the range from 0 ppm to 2.0 ppm. A total concentration of 3.0 ppm or less can be considered as neglectable and represents an excellent result. This concentration does not significantly affect organic compounds in the aqueous passivation solution. Furthermore, the method of the present invention allows such a low concentration even in the absence of bromide ions in the passivation solution. Very preferred is a method of the present invention, wherein the aqueous passivation solution comprises hexavalent chromium in a total concentration in the range from 0 ppm to 3.0 ppm over the entire life time the solution is utilized in the method of the present invention. If the concentration of hexavalent chromium is significantly above 6.0 ppm (e.g. 8 ppm or even more) an undesired degradation of the one or more than one species of carboxylic acid residue anions is observed, leading to an increased concentration of disturbing degradation products. This furthermore decreases the life time of the aqueous passivation solution. Typically, hexavalent chromium is determined and analyzed (including its quantification) by means of the commonly known diphenylcarbazide method. As mentioned above, quantification of hexavalent chromium is referenced to atomic chromium irrespective of further atoms in a respective compound/ion such as in chromate/dichromate, which are typical oxoanions of hexavalent chromium.

Above mentioned total concentration for hexavalent chromium applies not only after a respective aqueous passivation solution is freshly prepared but in particular after a respective aqueous passivation solution has been actively utilized for at least 8 hours in step (iii) of the method of the present invention.

Preferred is a method of the present invention, wherein the total concentration of the one or more than one species of carboxylic acid residue anions in the aqueous passivation solution is in the range from 10 times to 400 times the molar concentration of the trivalent chromium ions. Most preferred is a method of the present invention, wherein the aqueous passivation solution comprises formate anions in a concentration in the range from 1 g/L to 1700 g/L, based on the total volume of the passivation solution and referenced to a molecular weight of 45 g/mol for formate anions, preferably in the range from 8 g/L to 800 g/L, more preferably in the range from 20 g/L to 400 g/L, even more preferably in the range from 45 g/L to 210 g/L, most preferably in the range from 70 g/L to 130 g/L, even most preferred in the range from 95 g/L to 110 g/L. This is in particular preferred if formate anions are the only species of carboxylic acid residue anions.

Very preferred is a method of the present invention, wherein the aqueous passivation solution only or essentially comprises said trivalent chromium ions (including its anions), said one or more than one species of carboxylic acid residue anions (including its cations), optionally a pH adjusting agent, and optionally one or more than one wetting agent. This means that the aqueous passivation solution utilized in the method of the present invention preferably does not comprise other compounds/ions, except a tolerable amount of impurities, such as for example unavoidable amounts of hexavalent chromium.

Preferred is a method of the present invention, wherein the aqueous passivation solution does not comprise compounds or ions comprising side group elements except chromium. This means the passivation solution does not comprise compounds or ions comprising elements of groups 3 to 12 of the periodic table of elements, except chromium.

In the context of the present invention, the term "does not comprise" a subject-matter (e.g. a compound, a material, etc.) independently denotes that said subject-matter is not present at all or is present only in (to) a very little and undisturbing amount (extent) without affecting the intended purpose of the invention. For example, such a subject-matter might be added or utilized unintentionally, e.g. as unavoidable impurity. The term "does not comprise" preferably limits said subject-matter to 0 (zero) ppm to 50 ppm, based on the total weight of the aqueous passivation solution utilized in the method of the present invention, if defined for said solution, preferably to 0 ppm to 25 ppm, more preferably to 0 ppm to 10 ppm, even more preferably to 0 ppm to 5 ppm, most preferably to 0 ppm to 1 ppm. Most preferably said subject-matter is not detectable, which includes that said subject-matter is present with zero ppm or far less, which is most preferred.

Furthermore, a method of the present invention is preferred, wherein the aqueous passivation solution does not comprise compounds or ions comprising beryllium, aluminum, gallium, indium, germanium, tin, lead, arsenic, antimony, bismuth, and tellurium.

In some cases it is in particular preferred that the aqueous passivation solution utilized in the method of the present invention does not comprise compounds or ions comprising copper, zinc, nickel, cobalt, manganese, palladium, and iron.

It is assumed that compounds and ions as mentioned above negatively affect the passivation result if they are present in the aqueous passivation solution. Thus, trivalent chromium ions are preferably the only metal ions in the aqueous passivation solution out of group 3 to 12 metal ions according to the periodic table of elements. This means that preferably the passivation solution comprises sodium and/or potassium ions, preferably these are the only metal ions of group 1 and 2 according to the periodic table of elements.

A method of the present invention is preferred, wherein the aqueous passivation solution does not comprise sulfur containing compounds comprising a sulfur atom having an oxidation state below +6. Own experiments have shown that such sulfur containing compounds dramatically contribute to undesired discolorations and tarnishes, which is contrary to the objective of the present invention. Furthermore, such sulfur containing compounds negatively affect the entire passivation step in step (iii) of the method of the present invention. However, this does not exclude that the aqueous passivation solution contains sulfate ions (oxidation state of +6), for example as a source for said trivalent chromium ions. Sulfate ions do neither negatively interfere with the passivation step in step (iii) of the method of the present invention nor with the passivation layer.

A method of the present invention is preferred, wherein the aqueous passivation solution does not comprise phosphate ions. Own experiments have shown that phosphate anions additionally complex the trivalent chromium ions in the passivation solution. This is not desired because this affects the complexation of the trivalent chromium ions and maintenance of the entire passivation solution is more difficult to control.

A method of the present invention is preferred, wherein the aqueous passivation solution does not comprise nitrate ions. Own experiments have shown that nitrate anions promote degradation of the passivation solution and additionally form undesired conversion and degradation products, respectively, which must be avoided.

A method of the present invention is preferred, wherein the aqueous passivation solution does not comprise ammonium ions. Own experiments have shown that ammonium anions also form complexes with the trivalent chromium ions in the passivation solution. This is again not desired because this affects the complexation of the trivalent chromium ions and maintenance of the entire passivation solution is more difficult to control.

A method of the present invention is preferred, wherein the aqueous passivation solution does not comprise chloride ions, preferably does not comprise halogen ions at all. Own experiments have shown that in particular chloride anions form complexes with the trivalent chromium ions in the passivation solution. Again, this is not desired for the reasons already mentioned above. Chloride ions are in particular undesired if the passivation solution contains bromide ions.

A method of the present invention is preferred, wherein the aqueous passivation solution does not comprise boric acid, preferably does not comprise boron containing compounds at all. Boron containing compound, in particular boric acid, are typically toxic and, thus, preferably not contained in the passivation solution due to health and environmental reasons, e.g. waste water treatment. Own experiments have also shown that boron containing compounds form complexes with the trivalent chromium ions in the passivation solution. Again, this is not desired for the reasons already mentioned above. Furthermore, boron containing compounds are frequently used as buffer. However, it is an advantage of the method of the present invention that the passivation solution preferably does not need an additional buffer compound, most preferably if the molar ratio of the trivalent chromium ions with respect to all species of carboxylic acid residue anions (in particular formate anions) is at least 1:100 (i.e. 0.01) or less. Thus, preferred is a method of the present invention, wherein the aqueous passivation solution utilized in step (ii) does not comprise in addition to the one or more than one species of carboxylic acid residue anions, most preferably formate anions, a buffer compound other than carboxylic acid residue anions.

Thus, most preferred is a method of the present invention, wherein the aqueous passivation solution does not comprise sulfur containing compounds comprising a sulfur atom having an oxidation state below +6, boric acid, phosphate ions, nitrate ions, ammonium ions, and chloride ions, preferably does not contain sulfur containing compounds comprising a sulfur atom having an oxidation state below +6, boron containing compounds, phosphate ions, nitrate ions, ammonium ions, and halogen anions.

In most cases a method of the present invention is preferred, wherein the aqueous passivation solution does not comprise any halogen anions, in particular no chloride ions and no bromide ions. However, in some exceptional cases it is preferred that the aqueous passivation solution does comprise bromide ions in order to additionally suppress the anodic formation of hexavalent chromium. However, it is explicitly the advantage of the method of the present invention that in the aqueous passivation solution no bromide anions are needed. The anodic formation of hexavalent chromium is excellently suppressed by the molar ratio defined for the aqueous passivation solution. This is in particular the case if the molar ratio of the trivalent chromium ions with respect to all species of carboxylic acid residue anions (in particular formate anions) is at least 1:100 (i.e. 0.01) or less. As a result, costs can be saved and the life time of in particular mixed metal oxide coated anodes is prolonged. It has been shown in own experiments that mixed metal oxide coated anodes are susceptible to degradation in the presence of chloride ions, in particular if additionally bromide ions are present.

The aqueous passivation solution is for electrolytic passivation, which means that an external current is applied. Thus, preferred is a method of the present invention, wherein the aqueous passivation solution does not comprise a reducing agent for said trivalent chromium ions.

Preferred is a method of the present invention, wherein the trivalent chromium ions in the aqueous passivation solution are from trivalent chromium sulfate, trivalent chromium formate, and/or trivalent chromium oxalate, preferably from trivalent chromium sulfate and/or trivalent chromium formate.

In step (iii) of the method of the present invention the substrate (operated as cathode) is contacted with the aqueous passivation solution (preferably by immersing the substrate into the aqueous passivation solution) and an electrical current is passed between the substrate and the anode (the anode is also immersed into the aqueous passivation solution) such that a passivation layer is electrolytically deposited onto the surface of silver, silver alloy, gold, or gold alloy, respectively.

Preferred is a method of the present invention, wherein in step (iii) the electrical current has a cathodic current density in the range from 0.5 $A/dm^2$ to 25 $A/dm^2$, preferably 1 $A/dm^2$ to 24 $A/dm^2$, more preferably 3 $A/dm^2$ to 23 $A/dm^2$, even more preferably 4 $A/dm^2$ to 21 $A/dm^2$, most preferably 5 $A/dm^2$ to 19 $A/dm^2$. If the current density is significantly below 0.5 $A/dm^2$ generally an insufficient passivation is obtained. If the current density significantly exceeds 25 $A/dm^2$ typically an undesired strong evolution of hydrogen gas is observed along with undesired changes in the optical appearance. On the contrary, if the cathodic current density is in the range from 5 $A/dm^2$ to 19 $A/dm^2$, in particular in the range from 10 $A/dm^2$ to 14 $A/dm^2$, which is also a very preferred range, a very excellent passivation is quickly obtained, wherein the contacting in step (iii) is carried out by rack dipping into the passivation solution.

As indicated above, in the method of the present invention, the cathodic current density preferably depends on the specific application. Thus preferred is a method of the present invention, wherein in step (iii) the electrical current has a cathodic current density in the range from 0.5 $A/dm^2$ to 2 $A/dm^2$, preferably 0.8 $A/dm^2$ to 1.8 $A/dm^2$, more preferably 1 $A/dm^2$ to 1.6 $A/dm^2$, most preferably 1.2 $A/dm^2$ to 1.4 $A/dm^2$, wherein the contacting in step (iii) is carried out in a barrel.

Also preferred is a method of the present invention, wherein in step (iii) the electrical current has a cathodic current density in the range from 8 $A/dm^2$ to 25 $A/dm^2$, preferably 9 $A/dm^2$ to 23 $A/dm^2$, more preferably 10 $A/dm^2$ to 21 $A/dm^2$, most preferably 11 $A/dm^2$ to 18 $A/dm^2$, wherein the contacting in step (iii) is carried out by through flow contacting.

The electrical current passed in step (iii) of the method of the present invention is preferably a direct current, more preferably not including pulses. However, this current, as well as the concentration of trivalent chromium ions in the aqueous passivation solution, are not sufficient to deposit a solely metallic chromium layer. This means that the passivation layer is not an additional metallic chromium layer but rather a layer of mainly comprising compounds containing chromium atoms with an oxidation state of +3.

According to own experiments, the passivation layer electrolytically deposited in step (iii) at least comprises the elements chromium, carbon, and oxygen. Thus, preferred is a method of the present invention, wherein the passivation layer deposited in step (iii) at least comprises the elements chromium, carbon, and oxygen.

Preferred is a method of the present invention, wherein the passivation layer deposited in step (iii) comprises oxides and/or hydroxides of trivalent chromium, most preferably the passivation layer deposited in step (iii) at least comprises the elements chromium, carbon, and oxygen, including oxides and/or hydroxides of trivalent chromium.

Furthermore, the passivation layer obtained in step (iii) of the method of the present invention is a transparent layer. As a result, the method of the present invention is well suited to passivate decorative articles comprising a surface of silver, silver alloy, gold, or gold alloy, respectively, such as jewelry. The transparent passivation layer quickly allows a visual inspection of the quality of the surface. However, this likewise applies to electronic parts and therefore allows a quick quality and process control during and after the manufacturing process.

Preferred is a method of the present invention, wherein after step (iii) is carried out the passivation layer has a thickness of 500 nm or less, preferably of 400 nm or less.

Preferred is a method of the present invention, wherein in step (iii) the contacting is carried out for 1 second to 1000 seconds, preferably for 4 seconds to 800 seconds, more preferably for 8 seconds to 500 seconds, even more preferably for 15 seconds to 350 seconds, most preferably for 25 seconds to 220 seconds, even most preferably for 30 seconds to 150 seconds. If the contacting is significantly below 1 second, generally no sufficient passivation is obtained. If the contacting significantly exceeds 1000 seconds, typically undesired changes in the optical appearance, such as stains and blurs, are observed in some cases.

In the same way as the current density depends on the specific application, likewise the time of contacting in step (iii) depends on it. Thus, preferred is a method of the present invention, wherein in step (iii) the contacting is carried out for 1 second to 10 seconds, preferably for 2 seconds to 8 seconds, more preferably for 3 seconds to 6 seconds, wherein the contacting in step (iii) is carried out by through flow contacting.

Also preferred is a method of the present invention, wherein in step (iii) the contacting is carried out for 20 seconds to 400 seconds, preferably for 25 seconds to 350 seconds, more preferably for 30 seconds to 300 seconds, wherein the contacting in step (iii) is carried out by rack dipping into the passivation solution.

Furthermore preferred is a method of the present invention, wherein in step (iii) the contacting is carried out for 100 seconds to 1000 seconds, preferably for 200 seconds to 950 seconds, more preferably for 310 seconds to 900 seconds, even more preferably for 410 seconds to 850 seconds, wherein the contacting in step (iii) is carried out in a barrel.

Preferred is a method of the present invention, wherein in step (iii) the passivation solution has a temperature in the range from 25° C. to 70° C., preferably in the range from 31° C. to 65° C., more preferably in the range from 36° C. to 60° C., most preferably in the range from 40° C. to 50° C., even most preferably in the range from 41° C. to 49° C. A particularly preferred temperature is 45° C.±1° C. If the temperature significantly exceeds 70° C., an undesired and strong evaporation is often observed. If the temperature is significantly below 25° C. it is believed that the complex formation in the passivation solution is negatively affected resulting in an insufficient passivation.

In the method of the present invention (as described above, preferably as described as being preferred) it is preferred that in step (iii) the passivation layer is deposited in a single step without interruption.

Preferred is a method of the present invention, wherein the passivation layer deposited in step (iii) of the method of the present invention is the outermost layer. This means that preferably no further organic or metallic layer is deposited on top of the passivation layer.

Preferred is a method of the present invention, wherein in step (iii) the anode is selected from the group consisting of mixed metal oxide coated anodes, graphite anodes, and steel anodes, most preferably mixed metal oxide coated anodes. In particular preferred are insoluble anodes such as mixed metal oxide coated anodes. According to own experiments, in the method of the present invention, mixed metal oxide coated anodes result in an excellently low concentration of anodically formed hexavalent chromium, typically far below 2 ppm (see also text above). Preferably, the method of the present invention is carried out in such a way that the concentration of hexavalent chromium in the aqueous passivation solution (if at all anodically formed in step (iii)) remains below detection level. Preferred mixed metal oxide coated anodes comprise one or more than one oxide selected from the group consisting of titanium oxide, iridium oxide, ruthenium oxide, and platinum oxide. In particular preferred is a mixed metal oxide coated anode comprising platinum and titanium.

The present invention also refers to an aqueous passivation solution having a pH in the range from 5.4 to 7.2, the solution comprising trivalent chromium ions, and formate anions and/or oxalate anions as complexing agents for said trivalent chromium ions, wherein the trivalent chromium ions with respect to all formate anions together with all oxalate anions form a molar ratio in the range from 1:10 to 1:400, preferably in the range from 1:15 to 1:400.

The aforementioned features, in particular the aforementioned preferred features regarding the aqueous passivation solution utilized in the method of the present invention, apply likewise to the aqueous passivation solution of the present invention. This most preferably applies to above mentioned pH ranges.

Preferred is an aqueous passivation solution of the present invention, wherein the trivalent chromium ions are present in a concentration in the range from 0.1 g/L to 5.0 g/L, based on the total volume of the passivation solution, preferably in the range from 0.2 g/L to 4.0 g/L, more preferably in the range from 0.3 g/L to 3.0 g/L, even more preferably in the range from 0.4 g/L to 2.0 g/L, most preferably in the range from 0.5 g/L to 1.5 g/L, even most preferably in the range from 0.6 g/L to 1.2 g/L. For further information regarding this concentration, see the text above in combination with the method of the present invention.

Preferred is an aqueous passivation solution of the present invention, wherein said solution comprises said formate anions and the trivalent chromium ions with respect to all formate anions form a molar ratio in the range from 1:15 to 1:350, preferably in the range from 1:25 to 1:300, more preferably in the range from 1:40 to 1:250, even more preferably in the range from 1:55 to 1:200, most preferably in the range from 1:75 to 1:170, even most preferably in the range from 1:95 to 1:150, in particular preferably in the range from 1:110 to 1:130. In this very preferred case the aqueous passivation solution of the present invention preferably does not comprise oxalate anions, more preferably does not comprise carboxylic acid residue anions except formate anions.

The present invention also refers to a use of an aqueous passivation solution comprising trivalent chromium ions, and formate anions and/or oxalate anions as complexing agents for said trivalent chromium ions, wherein the trivalent chromium ions with respect to all formate anions together with all oxalate anions form a molar ratio in the range from 1:10 to 1:400 for electrolytically passivating a surface of silver, silver alloy, gold, or gold alloy.

During the use of the aqueous passivation solution a passivation layer is electrolytically deposited onto said surface by contacting a substrate comprising said surface with said solution and passing an electrical current between the substrate as a cathode and an anode.

Preferred is a use, wherein the aqueous passivation solution has a pH in the range from 5.4 to 7.2.

Very preferred is a use of formate anions, preferably of at least formate anions, most preferably of formate anions only. In case of formate anions only, the molar ratio is determined based only on trivalent chromium ions and formate anions.

The aforementioned features, in particular the aforementioned preferred features regarding the aqueous passivation solution utilized in the method of the present invention, apply likewise to the use of the present invention. This most preferably applies to the above mentioned pH range.

The invention is further explained by the following non-limiting examples.

Examples

In the following examples passivation solutions for comparison purposes and according to the present invention are prepared. Comparison examples are based on U.S. Pat. No. 4,169,022 A.

Generally, passivation solutions are obtained by mixing and dissolving trivalent chromium sulfate and potassium formate in water in order to obtain a pre-defined molar ratio. In each freshly prepared passivation solution the concentration of trivalent chromium ions is approximately 1 g/L (approximately 19.3 mmol/L). The respective pH is adjusted by adding KOH or formic acid.

For testing, in each example copper lead frames (approximately 97% Cu) are utilized comprising a surface of pure silver. Said silver surface belongs to a silver layer, which was, before that, deposited onto the copper lead frames by Atotech's process Silver Tech MS LED. The layer thickness of the deposited silver layer is approximately 200 nm.

Electrolytic passivation is carried out in each example for approximately 10 to 90 seconds with mixed metal oxide coated anodes. Directly after passivation, a fully transparent passivation layer is obtained not affecting the shiny appearance of the deposited silver layer.

Passivation properties are visually inspected by an expert panel directly after the passivation, after subjection to a $K_2S$-test, and after subjection to said $K_2S$-test+a heating step (60 minutes at 200° C.).

The $K_2S$-test is carried out as follows: After a passivation is carried out, a respective test sample is immersed into an aqueous solution containing potassium sulfide (2%) for 5 minutes. Afterwards the test sample is rinsed with water, dried and visually inspected.

Furthermore, the concentration of hexavalent chromium in the passivation solutions is determined by photometry utilizing 1.5-diphenylcarbazide against a calibration curve. A wave length of 540 nm and a cuvette with a path length of 1 cm is used. Typically, the concentration is determined after 8 hours utilizing the passivation solution in a passivation method.

Experimental results and further experimental parameters are summarized below in Table 1 (comparative examples) and Table 2 (examples according to the present invention).

TABLE 1 summary of parameters and experimental results, comparative examples

| no. | Molar ratio | pH | Temp [° C.] | CD [A/dm$^2$] | Cr(VI) | precipitation | Directly after passivation | After $K_2S$ | After $K_2S$ + baking |
|---|---|---|---|---|---|---|---|---|---|
| C1 | 1:2 | 5.5 | 30 | 6 | ✓ | yes | +++ | +++ | +++ |
| C2 | 1:2 | 5.5 | 30 | 12 | ✓ | yes | +++ | +++ | +++ |
| C3 | 1:2 | 5.5 | 45 | 6 | ✓ | yes | +++ | +++ | +++ |
| C4 | 1:2 | 5.5 | 45 | 12 | ✓ | yes | +++ | +++ | +++ |
| C5 | 1:2 | 6.5 | 30 | 6 | ✓ | yes | +++ | + | + |
| C6 | 1:2 | 6.5 | 30 | 12 | ✓ | yes | +++ | + | + |
| C7 | 1:2 | 6.5 | 45 | 6 | ✓ | yes | +++ | + | + |
| C8 | 1:2 | 6.5 | 45 | 12 | ✓ | yes | +++ | + | + |
| C9 | 1:6 | 5.5 | 30 | 6 | ✓ | yes | +++ | +++ | +++ |
| C10 | 1:6 | 5.5 | 30 | 12 | ✓ | yes | +++ | +++ | ++ |
| C11 | 1:6 | 5.5 | 45 | 6 | ✓ | yes | +++ | +++ | +++ |
| C12 | 1:6 | 5.5 | 45 | 12 | ✓ | yes | +++ | +++ | +++ |
| C13 | 1:6 | 6.5 | 30 | 6 | ✓ | yes | +++ | + | + |
| C14 | 1:6 | 6.5 | 30 | 12 | ✓ | yes | +++ | + | + |
| C15 | 1:6 | 6.5 | 45 | 6 | ✓ | yes | +++ | + | + |
| C16 | 1:6 | 6.5 | 45 | 12 | ✓ | yes | +++ | + | + |

In each comparative example an inacceptable concentration of hexavalent chromium (Cr(VI)) of typically more than 8 ppm, is observed after 8 hours, indicated by the symbol "√".

Furthermore, in each comparative example an inacceptable precipitation is observed either already during the preparation of the solution or shortly after the passivation was initiated. Although a satisfying passivation can be still obtained with some of the tested comparative examples, in no case the tested solutions were sufficiently stable and clear of precipitates. Thus, the life time is not acceptable.

In Table 1 (and in the following Table 2) "+++", "++", and "+" describe the following observations:

"+++" denotes an excellent result, i.e. a homogeneous, shiny passivated silver surface without a disturbing tarnish, "++" denotes an acceptable result, i.e. a shiny passivated silver surface with an undisturbing tarnish, "+" denotes failed, i.e. the passivated silver surface is not sufficiently shiny and has a disturbing tarnish; the test sample is not acceptable Furthermore, "CD" denotes current density.

Above comparative examples show that good passivation results can be obtained with a passivation solution having a pH around 5.5. Having a pH of around 6.5, the passivation result is drastically reduced after the $K_2S$-test, in particular after an additional heat treatment. Thus, the operating window is limited to a pH value closely around 5.5.

TABLE 2 summary of parameters and experimental results, examples according to the present invention

| no. | Molar ratio | pH | Temp [° C.] | CD [A/dm$^2$] | Cr(VI) | precipitation | Directly after passivation | After $K_2S$ | After $K_2S$ + baking |
|---|---|---|---|---|---|---|---|---|---|
| E1 | 1:15 | 5.5 | 30 | 6 | — | no | +++ | +++ | +++ |
| E2 | 1:15 | 5.5 | 30 | 12 | — | no | +++ | +++ | +++ |
| E3 | 1:15 | 5.5 | 45 | 6 | — | no | +++ | +++ | +++ |
| E4 | 1:15 | 5.5 | 45 | 12 | — | no | +++ | +++ | +++ |
| E5 | 1:60 | 5.5 | 30 | 6 | — | no | +++ | +++ | +++ |
| E6 | 1:60 | 5.5 | 30 | 12 | — | no | +++ | +++ | +++ |
| E7 | 1:60 | 5.5 | 45 | 6 | — | no | +++ | +++ | +++ |
| E8 | 1:60 | 5.5 | 45 | 12 | — | no | +++ | +++ | +++ |
| E9 | 1:120 | 5.5 | 30 | 6 | — | no | +++ | +++ | +++ |
| E10 | 1:120 | 5.5 | 30 | 12 | — | no | +++ | +++ | +++ |
| E11 | 1:120 | 5.5 | 45 | 6 | — | no | +++ | +++ | +++ |
| E12 | 1:120 | 5.5 | 45 | 12 | — | no | +++ | +++ | +++ |
| E13 | 1:120 | 6.5 | 40 | 12 | — | no | +++ | +++ | +++ |
| E14 | 1:120 | 5.5 | 40 | 12 | — | no | +++ | +++ | +++ |
| E15 | 1:120 | 5.5 | 40 | 18 | — | no | +++ | +++ | +++ |
| E16 | 1:120 | 6.0 | 40 | 18 | — | no | +++ | +++ | +++ |
| E17 | 1:120 | 6.5 | 40 | 18 | — | no | +++ | +++ | +++ |

In each example according to the present invention an acceptable concentration of hexavalent chromium (typically around 4 to 5 ppm) is observed after 8 hours, indicated by the symbol "—". Examples having a molar ratio of 1:120 show an even better, i.e. lower concentration of hexavalent chromium, typically below 3 ppm, in many cases a concentration of 2 ppm or even below.

Furthermore, in each example according to the present invention no significant precipitation is observed, thus, indicating an excellent life time and solution stability. In particular in examples E9 to E17 (molar ratio 1:120) no precipitation is observed, neither during the preparation of the respective passivation solution nor during utilizing the passivation solution. Although an undisturbing and neglectable tiny amount of precipitate sometimes occurs in examples E1 to E8 during utilizing the passivation solution (i.e. after some hours of passivating), still very acceptable passivation results are obtained. Very similar data are obtained with passivation solutions having a pH of 7.0 and 7.5, which generally show tiny precipitation but without negatively affecting the passivation result. However, own experiments indicate that precipitation significantly increases with increasing pH.

All examples according to the present invention exhibit excellent passivation results directly after the passivation, after the $K_2S$-test, and after $K_2S$-test+baking.

It is also noteworthy that above mentioned excellent results are achieved at pH values of 5.5, 6.0, and 6.5, which is a much broader pH range compared to the comparative examples.

The invention claimed is:

1. A method for electrolytically passivating a surface of silver, silver alloy, gold, or gold alloy, the method comprising the steps of:

(i) providing a substrate comprising said surface, (ii) providing an aqueous passivation solution comprising:

trivalent chromium ions, and one or more than one species of carboxylic acid residue anions, (iii) contacting the substrate with said passivation solution and passing an electrical current between the substrate as a cathode and an anode such that a passivation layer is electrolytically deposited onto said surface, wherein the trivalent chromium ions with respect to all species of carboxylic acid residue anions form a molar ratio in the range from 1:10 to 1:400, and wherein the trivalent chromium ions are present in the aqueous passivation solution at a concentration in the range from 0.1 g/L to 5.0 g/L, based on total volume of the passivation solution.

2. The method of claim 1, wherein the aqueous passivation solution has a pH in the range from 3.1 to 7.5.

3. The method of claim 1, wherein the one or more than one species of carboxylic acid residue anions are species of aliphatic carboxylic acid residue anions.

4. The method of claim 1, wherein the one or more than one species of carboxylic acid residue anions comprises formate anions, oxalate anions, or both format anions and oxalate anions.

5. The method of claim 1, wherein in the passivation solution the molar ratio is in the range from 1:15 to 1:350.

6. The method of claim 1, wherein in step (i) the surface of silver alloy and gold alloy, respectively, individually comprises a total amount of silver and gold, respectively, of 55 atom-% or more, based on the total amount of atoms in the respective surface.

7. The method of claim 1, wherein the aqueous passivation solution does not comprise sulfur containing compounds comprising a sulfur atom having an oxidation state below +6, boric acid, phosphate ions, nitrate ions, ammonium ions, and chloride ions.

8. The method of claim 1, wherein in step (iii) the electrical current has a cathodic current density in the range from 0.5 $A/dm^2$ to 25 $A/dm^2$.

9. The method of claim 1, wherein the passivation layer deposited in step (iii) at least comprises the elements chromium, carbon, and oxygen.

10. The method of claim 1, wherein the passivation layer deposited in step (iii) comprises oxides, hydroxides, or both oxides and hydroxides of trivalent chromium.

11. The method of claim 1, wherein in step (iii) the contacting is carried out for 1 second to 1000 seconds.

12. The method of claim 1, wherein in step (iii) the passivation solution has a temperature in the range from 25° C. to 70° C.

13. The method of claim 1, wherein the passivation layer is present at a thickness of 500 nm or less.

14. The method of claim 1, wherein the passivation layer is transparent.

15. The method of claim 1, wherein the trivalent chromium ions with respect to all species of carboxylic acid residue anions form a molar ratio in the range from 1:25 to 1:400.

* * * * *